United States Patent [19]

Lipsey

[11] 3,949,954

[45] Apr. 13, 1976

[54] LORAN GUIDANCE FOR REMOTE BOMB

[75] Inventor: Elmer M. Lipsey, Annandale, Va.

[73] Assignee: Ato Inc., Willoughby, Ohio

[22] Filed: July 26, 1971

[21] Appl. No.: 166,147

[52] U.S. Cl. ..... 244/3.15
[51] Int. Cl.[2] ..... F41G 7/00
[58] Field of Search ..... 244/3.15

[56] References Cited

UNITED STATES PATENTS 2,821,349 1/1958 Sohn ..... 244/3.15

*Primary Examiner*—Samuel Feinberg
*Attorney, Agent, or Firm*—Sughrue, Rothwell, Mion, Zinn & Macpeak

[57] ABSTRACT

A projectile carrying a Loran processor is directed to a target along a line, referred to as a lorhumb line, which is the locus of all points i for which TDA− $TDA_i$/TDB− $TDB_i$ is constant. Any deviation results in a cross-track error directing the projectile back on a correct path to the target. No vertical tracking is necessary because the projectile is flown near to the target and caused to execute a ballistic foldover so that it travels vertically downward towards the target. During vertical descent an along-path error signal is generated to control the vertical fins of the projectile.

18 Claims, 7 Drawing Figures

INVENTOR
ELMER M. LIPSEY

BY Sughrue, Rothwell, Mion, Zinn & Macpeak

ATTORNEYS

LORAN GUIDANCE FOR REMOTE BOMB

BACKGROUND OF THE INVENTION

The invention is a method and system for generating flight path signals for directing a projectile to a known point. More particularly the invention is a method and system for guiding projectiles or drone vehicles via loran signals.

Guidance signals for projectiles such as bombs have been known for a long time. Also, loran navigation systems have been known for a long time. However, despite the very high accuracy provided by loran systems, loran has never before been successfully used for projectile guidance. One of the problems is that loran is a two dimensional navigation system whereas a projectile flys in a three dimensional system.

Desirable criteria of a guidance system are: it must be accurate, relatively inexpensive, and must not require the operator of a launch vehicle to wait around in the vicinity of the enemy while guiding the projectile toward the target. Most guidance systems do no satisfy at least one of the criteria. A loran guidance system in accordance with the present invention is accurate — present day accuracy of Loran-C is common knowledge; inexpensive — no transmission equipment cost is involved since loan transmitting stations are already in existence for navigation; and does not require the launch vehicle to wait around the launch area — the loran processor/receiver is on the projectile, and after launch, no sigals need be transmitted to the projectile from the launch vehicle.

SUMMARY OF THE INVENTION

A projectile carrying a loran receiver/processor is initialized with the loran coordinates $TDA_T$ and $TDB_T$ of a target and one set of loran coordintes $TDA_P$ or $TDB_P$ of a point in advance of the target, referred to as the foldover or pushover point. At launch, the coordinates of the launch point, $TDA_L$ and $TDB_L$, are received and detected. The projectile flys along the path which is the locus of all points i for which the ratio $TDA_T - TDA_i/TDB_T - TDB_i$ equals a constant. The path, commonly known as a lorhumb line, is maintained by mechanizing an equation which provides an indication of deviation from the path in the horizontal plane and controlling the control rudder (vertical fins in horizontal flight) of the projectile. The altitude is not monitored but the projectile is launched at a sufficient altitude so that the projectile will still be substantially above the target when it reaches a target coordinate $TDA_T$ and $TDB_T$. At the foldover point, $TDA_P$, and $TDB_P$, the projectile executes a ballistic foldover, which is a simple known maneuver to cause a projectile to turn downward. During vertical descent the deviation from the path, described above, is detected and apparatus responsive to the detection continues to control the horizonzal control rudder. A distance-to-go equation is mechanized by apparatus for controlling the vertical control elevators.

DETAILED DESCRIPTION OF THE DRAWINGS

Figures 1, 2:
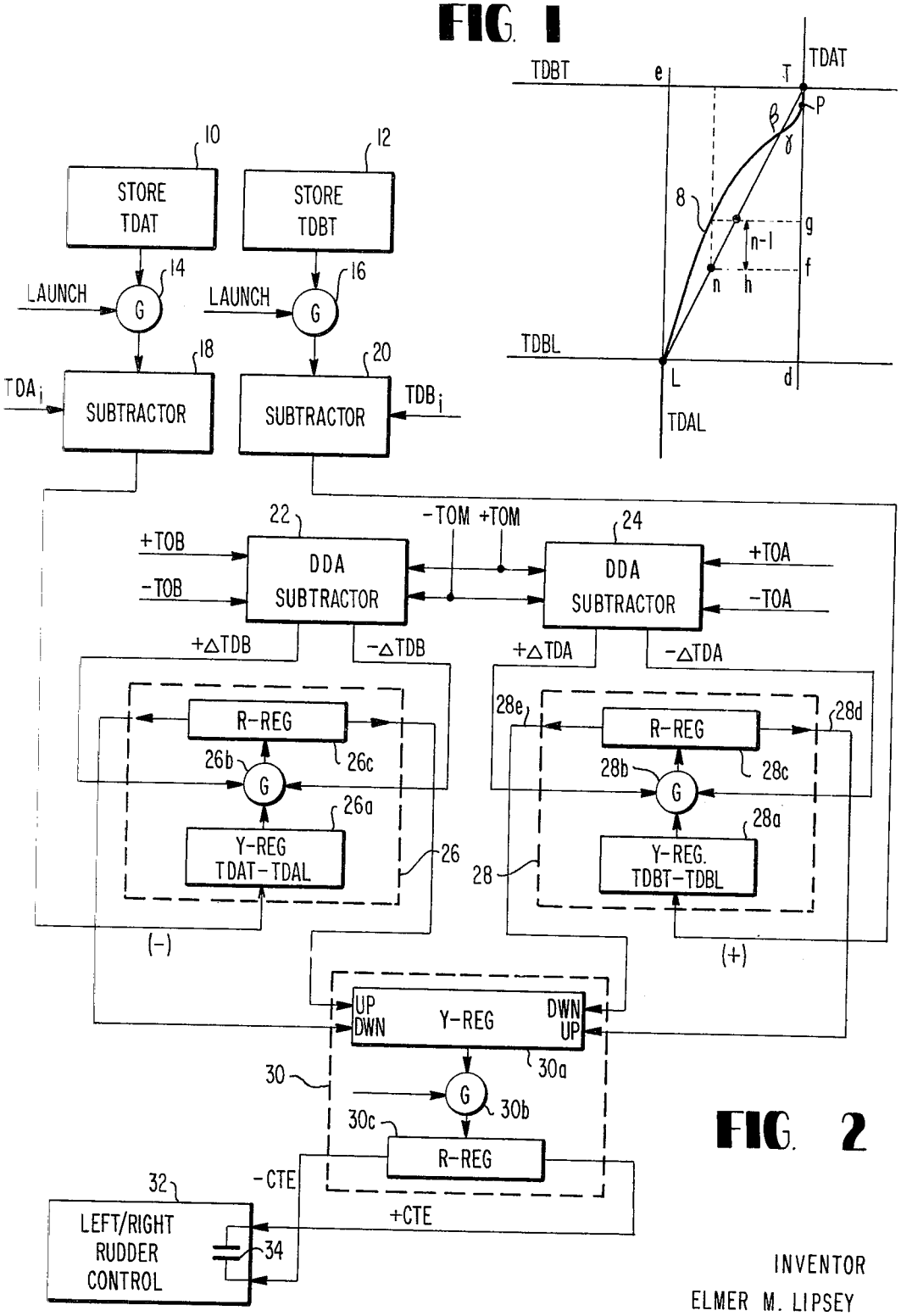
FIG. 1 illustrates a portion of a loran coordinate system and the flight path of a projectile flown in accordance with the teachings of this invention.
FIG. 2 is a block diagram of apparatus for generating cross track error signals.

Referring to FIG. 1 there is shown a small portion of a Loran coordinate system. The horizontal lines are assumed to be the lines of equal time difference for pulses from the conventional loran master and slave B stations; the vertical lines are assumed to be the lines of equal time distance for pulses from the master and slave A stations. As is well known, the loran coordinates of any point may be designated as TDA and TDB representing respectively, the time difference of arrival between the master and slave A and the time difference of arrival between the master and slave B transmitted pulses. One further assumption is made, which is inaccurate, but which, as will be explained later, does not have any serious effect on the calculations. The assumption is that all lines of constant TDB are parallel to each other and all lines of constant TDA are parallel to each other and perpendicular to the TDB lines. It will be noted that this assumption approaches validity as one diminishes the size of the geographical area under consideration.

In the graph the point T, having loran coordinates TDAT and TDBT, represents the target point and the point L, having coordinates TDAL and TDBL, represents the launch point. At the launch point, a projectile having a loran processor/receiver on board will be launched and directed to the target point T. It can be seen that for any point n along the path LT, the ratio of the short side to the long side, NF/FT, is constant and equal to LD/DT. The cross track error of the projectile can be determined by detecting when the ratio is not constant. Converting the lengths into loran coordinates we have, $$\frac{LD}{DT} = \frac{(TDAT - TDAL)\nabla TDA}{(TDBT - TDBL)\nabla TDB} = \text{Constant } K$$

where the $\nabla$TDA (the gradient of TDA) is the change in distance perpendicular to the TDA line per unit change in TDA measurement, and $\nabla$TDB is the change in distance perpendicular to a TDB line per unit change in TDB.

For any point n on the line LT, $$\frac{(TDAT - TDA_n)\nabla TDA}{(TDBT - TDB_n)\nabla TDB} = K$$

Since the gradients are known in advance and are constant throughout the flight path, the ratio $TDAT - TDA_n/TDBT - TDB_n$ is constant for all points n on the flight path LT. Thus, the flight path may be defined as the locus of all points n for which the latter ratio is constant.

Since at point n the expression (LD) (FT)− (DT) (NF) = 0, will hold true, an indication of the cross track error, CTE, may be defined as CTE=(TDAT− TDAL) ∇ TDA (TDBT− $TDB_n$)∇ TDB− (TDBT− TDBL) ∇ TDB (TDAT− $TDA_n$)∇ TDA. It will be noted from the above equation and by examining the diagram in FIG. 1 that the sign of CTE indicates whether the projectile is off to the right or left of the flight path but the value does not provide an accurate indication of the distance off the flight path. The above CTE indication could be used to direct the horizontal control rudder of the projectile to turn a projectile back towards the flight path, but in the absence of some accurate indication of distance away from the flight path, the projectile would simply fly back and forth across the flight path.

In order to generate signals which provide an indication of the amount as well as the direction of the cross track error thereby enabling the projectile to be flown smoothly onto the flight path, signals dependent upon the differential or incremental contribution to the cross track error are generated. That is, using an incremental time of the computer to be described hereafter, referred to as the word time, the contribution to the cross track error resulting from the flight during that incremental time is detected. By integrating or smoothing the incremental cross track error signals a final signal is obtained which is proportional to the distance off the path and has a sign indicating the direction off the path.

If one considers the points *n* and *n*- 1 along the flight path as representing an incremental distance, one derives the following expression, $$\frac{(TDAT - TDAL)\nabla TDA}{(TDBT - TDBL)\nabla TDB} = \frac{\Delta TDA \nabla TDA}{\Delta TDB \nabla TDB}.$$

where ΔTDA and ΔTDB represent the difference in the loran coordinates between points *n*- 1 and *n*. From the above expression after dividing out the constant ∇TDA/∇TDB and multiplying both sides by the denominators one obtains the following expression which represents the differential or incremental cross track error;

CTE = (TDAT− TDAL) ΔTDB− (TDBT− TDBL) ΔTDA.

As pointed out above, the assumption that the lines of constant TDA are parallel to each other and perpendicular to lines of constant TDB, is inaccurate. However, the inaccuracy does not affect the accuracy of the equations, it merely results in a flight path, defined by the equation, which is not a straight line LT between launch point and target. The flight path defined by the equations above will appear something like line 8 in FIG. 1. The difference between a straight line flight path and a curved line flight path is insignificant since each direct the projectile to the target point T.

One example of a computer for mechanizing the incremental cross track error equation is illustrated in FIG. 2. The illustrated computer comprises digital differential analyzers (DDA) 22, 24, 26, 28 and 30. Since digital differential analyzers are well known in the art they will not be described in great detail herein. As is well known, digital differential analyzers can operate as multipliers or subtracters and may operate in a servo mode or a non-servo mode. The computer described herein for mechanizing the cross track error equation is on board the projectile along with a loran receiver/processor. The details of a loran receiver/processor are not shown herein as those details do not form a part of the present invention. Many digital loran receiver/processors are known and for the purpose of understanding the present invention it is assumed that the signals applied to the computer from the loran receiver/processor come from digital Loran-C receiver/processor.

As shown in FIG. 2, the loran coordinates of the target are entered into storage means 10 and 12 and held there for use by the computer. At launch time, the coordinate TDAT in storage means 10 is passed through gate 14 to one input of a subtractor 18. The other input of the subtractor 18 is constantly receiving the present TDA from the loran receiver/processor. The latter is designated as $TDA_i$. The subtractor is made to have a zero output except at launch time when the output is a value representing (TDAT-TDAL). The latter difference value is entered into the Y-register 26*a* of the digital differential analyzer 26. The subtractor 20 and gate 16 operate in the same manner as subtractor 18 and gate 14 to provide the value TDBT- TDBL at launch time to the Y register 28*a* of the digital differential analyzer 28. Pulses representing incremental changes in the TDB coordinate and designated as plus or minus Δ TDB, are generated by the digital differential analyzer 22 which receives the plus and minus TOB and TOM pulses from the loran receiver/processor and operates as a subtractor. The TOB pulses represent incremental changes in the time of arrival of the slave B pulses at the loran receiver/processor and the plus or minus TOM pulses represents incremental change in the time of arrival of the master pulses at the loran receiver/processor.

As is well known, all digital loran receivers/processors contain three phase locked loops which generate timing pulses synchronized to the master, slave A, and slave B pulses, respectively. When the locally generated timing pulses are out of phase with the received pulses, as a result of movement of the receiver, incremental shift pulses are generated and sent to a phase shifter to bring the locally generated timing pulses into coincidence with the received pulses. The latter incremental shift pulses are indicated herein by the designations plus or minus TOM, plus or minus TOA, and plus or minus TOB in FIG. 2. A plus TOM indicates a relative shift forward in time for the master pulse, whereas a minus TOM indicates relative shift back in time for the master pulse. Thus, as is apparent, during an increment of time, if there is a single plus TOM pulse and no TOB pulses, there will be a positive incremental change in TDB and this will be indicated by the generation of a pulse on the line indicated as plus Δ TDB. On the other hand, if the incremental shift pulses indicate a convergence of the time of arrival of the master and slave B pulses a minus Δ TDB pulse will be generated. The digital differential analyzer 24 operates in the same way as digital differential analyzer 22 except that it receives plus and minus TOA pulses instead of plus and minus TOB pulses and generates plus and minus Δ TDA pulses. A simple example of the logic carried out by the DDA's 22 and 24 is illustrated in FIG. 3.

Figure 3:
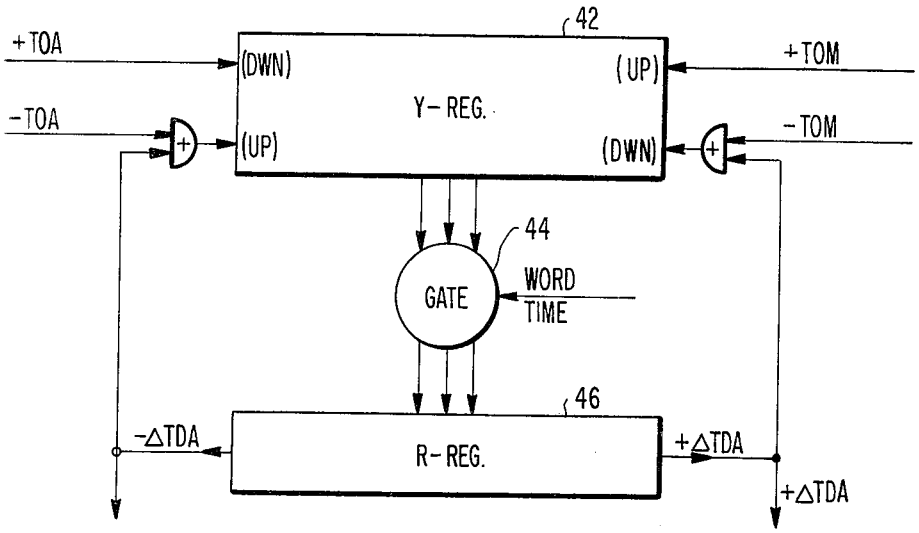
FIG. 3 is a block diagram of the logic operation performed by subtractors in FIG. 2.

As seen in FIG. 3, the incremental shift pulses, plus and minus TOA and plus and minus TOM, are applied to a Y- register 42 which is capable of counting up and down. The shift pulses are applied to respective up and down input terminals as shown depending upon whether the shift is in the direction of an increase in TDA or a decrease in TDA. Locally generated clock pulses, having a period defined as the word time, are applied to gate 44 which operates to pass the contents of the Y register to the R register 46. The word time determines the period of calculation. In the simplest example, the R register 46 may be a zero detecter which detects when the contents of the Y register is not zero and provides an output plus Δ TDA if the sign in the Y register 42 indicates a positive value and a pulse on the line minus Δ TDA if the sign in the Y register indicates a negative value. The plus Δ TDA pulses are fed back to a down input of Y register 42 and the minus Δ TDA pulses are fed back into an up input terminal of the Y register 42.

As an example of how the apparatus would operate assume that the Y register is initially at zero and over a period expanding three word times the loran processor/receiver generates two minus TOA shift pulses, both occurring during the first word time. The minus TOA shift pulses occurring during the first word time indicate that the slave A pulses have moved further back in time. The latter pulses cause the Y register 42 to count up to a value corresponding to plus 2. At the end of the first period a clock pulse is applied to gate 44 and the R register detects the plus 2 contents of the Y register and puts out a plus Δ TDA pulse. The plus Δ TDA pulse as well as being applied to other circuitry to be described later, counts the Y register down one unit so that it now contains a plus one. At the end of the second word time, the next clock pulse is applied to gate 44, and the R register 46 operates to detect the plus one condition in the Y register 42 and generate another plus Δ TDA pulse. The latter pulse counts the Y register down to zero. At the end of the third word time, another clock pulse is applied to gate 44. The R register 46 detects the zero value in the Y register and consequently will not generate any pulses. Thus, two incremental shift pulses indicating an increase in TDA over a three word time period results in two plus Δ TDA pulses corresponding to two increments of increase of TDA. It will be noted that a single minus TOA pulse and a single plus TOM pulse will have the same effect. It will also be appreciated by any one of ordinary skill in the art that the scaling factor may be varied simply by altering the logic so that a larger number of incremental shift pulses are required to generate a single plus or minus Δ TDA pulse.

Referring back to FIG. 2, the plus and minus Δ TDA pulses from the DDA subtractor 24 are applied to a gating means **28*b* of the DDA 28. The logic of the DDA 28 is such that each plus Δ TDA pulse causes the value TDBT-TDBL stored in the Y register to be added to the contents of R register 28*c*, whereas a minus Δ TDA pulse causes the same contents of the Y register 28*a* to be subtracted from the R register 28*c*. Each time an overflow occurs in the R register a pulse is generated on line 28*e*, whereas each time an underflow occurs in the R register a pulse is generated on line 28*d*. Consequently, the DDA 28 operates as a multiplier and provides output pulses at a rate proportional to Δ TDA (TDBT- TDBL). It will be appreciated by anyone of ordinary skill in the art that the scaling factor of the DDA multiplier 28 may be easily varied by changing the length of the R register 28*c*. The DDA multiplier 26 operates in the same as the DDA multiplier 28** and generates pulses at a rate proportional to Δ TDB (TDAT- TDAL).

The pulses from DDA multiplier 26 and 28 are applied to a DDA subtractor 30 which generates plus CTE and minus CTE pulses. Each CTE pulse generated represents a differential or incremental cross track error as described above. The CTE pulses are integrated or smoothed, as by a capacitive means illustrated at 34, and applied to the left/right rudder control means 32, otherwise referred as the horizontal control rudder, which operates to vary the angle of the rudder in accordance with the smoothed CTE pulses to guide the projectile smoothly back on to the flight path. In the DDA subtractor 30 the input pulses are applied to up or down input terminals, as illustrated, of the Y register **30*a* which is initially at zero. At each word time, a clock pulse is applied to gate 30*b* to transfer the contents of the Y register 30*a* to the R register 30*c***. An overflow of the R register generates a plus CTE pulse and an underflow of the R register generates a minus CTE pulse.

Figure 4:
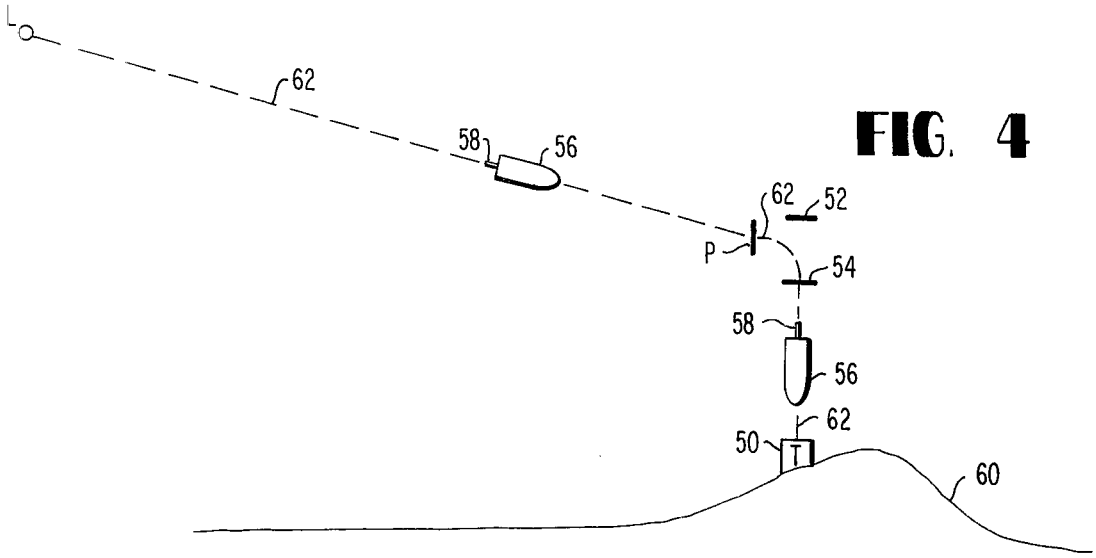
FIG. 4 illustrates the flight path from a side view.

As is well known a loran system only defines coordinate information in a 2-dimensional plane, and thus, the loran receiver/processor is incapable of determining the altitude of the projectile. Furthermore, the target may be on a mountain or in a valley but the loran coordinates of the target which are initially stored do not take into account the possible variation in altitude of the target. This apparent deficiency of loran is overcome in accordance with the present invention by the technique of flying the projectile along a path which, as viewed in horizontal cross section is similar to the path of broken line 62 in FIG. 4. As shown in the figure, the projectile 56, launched from the launch point L, flys towards the target 50 which is on a hill 60. During the first phase of the flight only the cross track error is monitored to guide the projectile along the lorhumb line. No loran process signals are generated having any relation to the altitude of the projectile 56 above the ground or above the target 50. At a foldover or push-over point P the second phase of flight begins. When the projectile 56 reaches point P the projectile executes an automatic ballistic foldover by angularly positioning the vertical control elevator 58 of the projectile 56 to cause the projectile to turn its nose downward. At point 54 the nose will be turned downward and the third phase of the flight occurs. During the third phase the cross track error continues to be generated and controls the horizontal control rudder (not shown) which adjust the position of the projectile 56 in the plane perpendicular to the drawing of FIG. 4. In addition to the cross track error, the computer also generates a distance-to-go signal which controls the vertical control elevator 58 to properly position the projectile in the plane which is parallel to the plane of the paper. As a result of the flight path described it is easily seen that there is no need to know the accurate altitude position of a target or to monitor the altitude of the projectile. It is important, however, that the projectile, either by its own propulsion means or by launching it at a sufficient altitude, be at an altitude above the target when it reaches the foldover point P which is at least equal to or greater than the distance between points 52 and 54. The distance between 52 and 54 represents the altitude drop of the projectile during foldover from a horizontal flight to a vertical flight.

The actual foldover point P may be determined in advance by knowledge of the characteristics of the projectile. It is assumed that the projectile is flying on the lorhumb line by the time it reaches point P and therefore it is only required that the on-board system monitor either $TDA_i$ or $TDB_i$ and generate a logic output for initiating foldover when the value of $TDA_i$ reaches the value of the stored TDAP or when the value of $TDB_i$ reaches the value of the stored TDBP.

Figure 5:
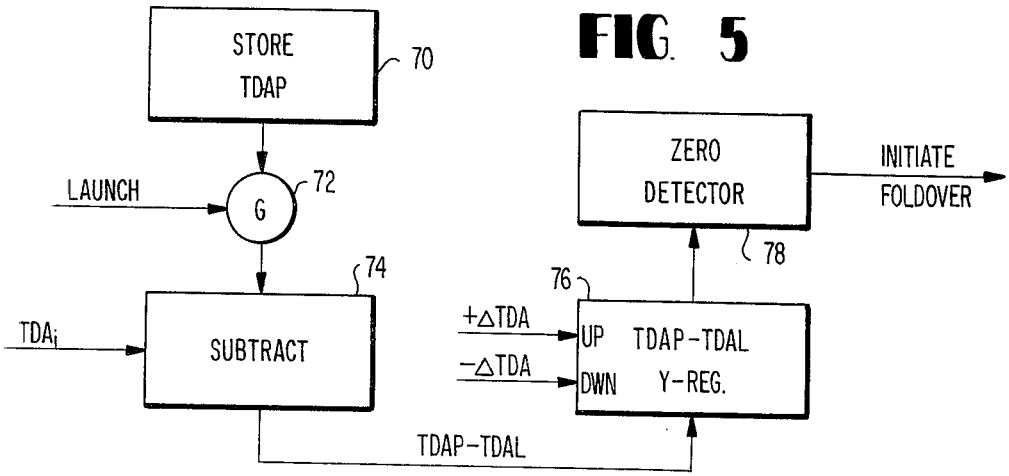
FIG. 5 is a block diagram of apparatus for initiating ballistic foldover of a projectile.

That portion of the computer which generates the initiate foldover signal, and thereby starts phase 2 of the flight is illustrated in FIG. 5.

As illustrated, the known value of TDAP is stored in storage means 70 and, at the time of launch, passes through gating means 72 to one input of a subtractor 74. The other input of the subtractor 74 receives the present loran coordinate $TDA_i$ from the loran receiver/processor. The subtractor 74 only provides an output at the time of launch and its output corresponds to the value TDAP- TDAL. The latter value is inserted into the Y register 76 at launch time and it is incremented by each plus Δ TDA pulse and decremented by each minus Δ TDA pulse. The plus and minus Δ TDA pulses may be taken from the DDA subtractor 24 in FIG. 2 and correspond to incremental changes in the TDA coordinate. Consequently, the value stored in the Y register is continually updated and represents the value TDAP- $TDA_i$. The value in the Y register 76 approaches zero as the projectile approaches the foldover point P. When the foldover point is reached the zero condition of the Y register 76 is detected by a zero detector 78 which generates an output signal for initiating the foldover. The details of a mechanism for responding to the signal from detector 78 and executing the ballistic foldover maneuver are not shown as such details are not part of the present invention.

During phase three, the vertical phase, it is necessary to control the position of the projectile along the flight path as well as controlling its cross track position. This is accomplished in the present system by generating a signal, or specifically a pulse rate, which is proportional to the distance to go to the target coordinates, said signal or pulses varying in sign as the projectile flys over the target. Referring back to FIG. 1 it can be seen that the distance to go from any point n to the target point T may be expressed as, $$DTG_n = (TDAT - TDA_n)\,\nabla TDA \sin\alpha, \text{ or}$$

$$DTG_n = (TDBT - TDB_n)\,\nabla TDB \cos\beta.$$

Either of the above equations may be used to generate the distance to go (DTG) and in the mechanization of the DTG equation in the preferred embodiment disclosed herein, both are used and averaged. Since the ∇ TDA, ∇ TDB sin $\alpha$, and cos $\beta$ do not change (all are easily calculated in advance of launch by known methods), the equation for $DTG_i$ at any point $i$ may be given by, $$DTG_i = \frac{K_1}{2}(TDAT - TDA_i) + \frac{K_2}{2}(TDBT - TDB_i).$$

Figure 6:
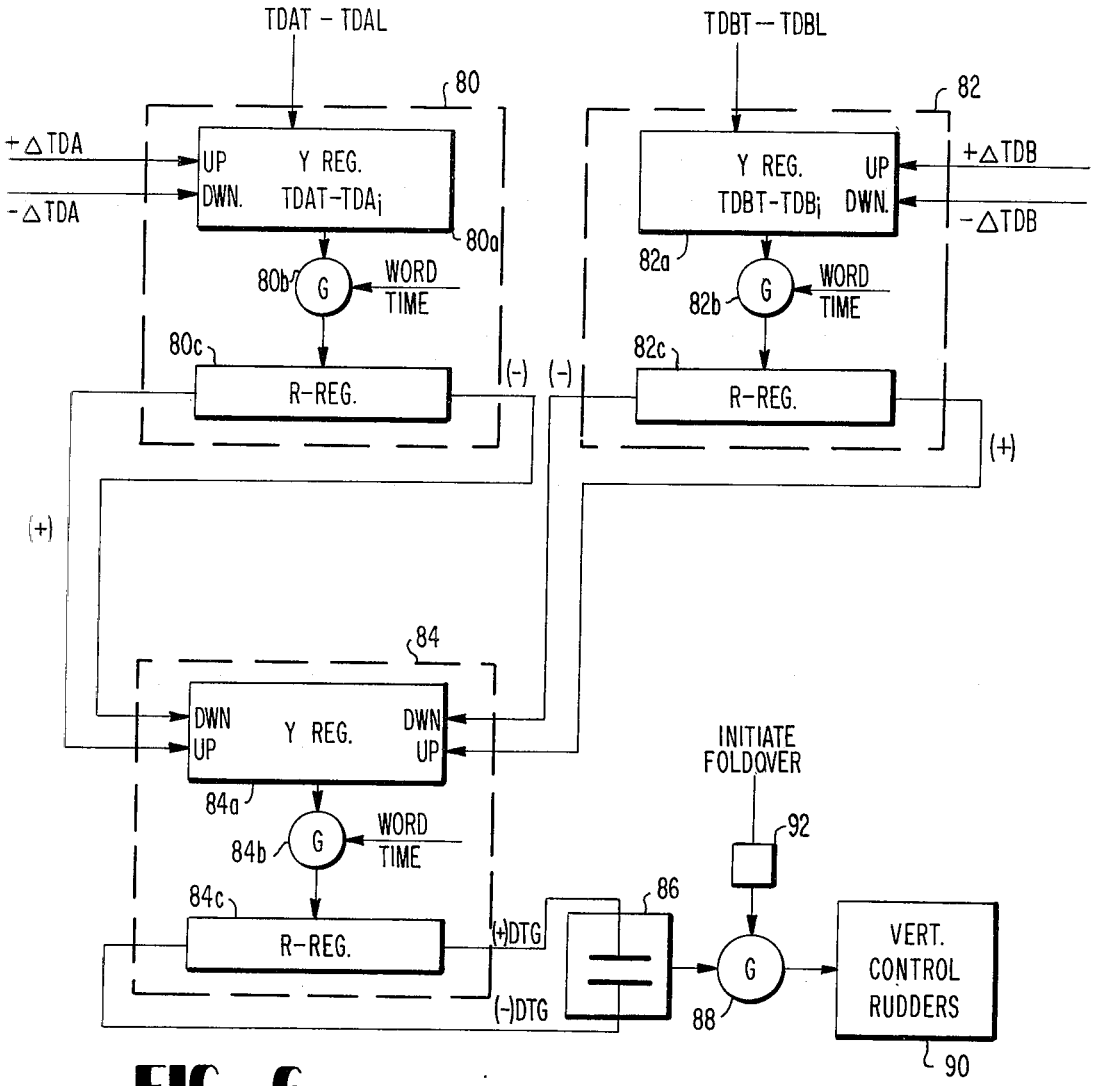
FIG. 6 is a block diagram of apparatus for generating a distance-to-go signal.

That portion of the computer which generates the DTG pulses is illustrated in FIG. 6 and comprises primarily three digital differential analyzers 80, 82, and 84. In the mechanization of the DTG equation, the scaling factors $K_{1/2}$ and $K_{2/2}$ may be set as is well known by a proper setting of the lengths of the R registers. DDA 80 is initialized with the value TDAT- TDAL which is received from the subtractor 18 in FIG. 2, and DDA 82 is initialized with the value TDBT-TDBL which is received from the subtractor 20 in FIG. 2. The value stored in the register 80*a* is updated by the incremental shift pulses plus and minus Δ TDA and therefore the value in the Y register constantly represents TDAT- $TDA_i$. This value is transferred to the R register $\mathbf{80}_c$ via gating means $\mathbf{80}_b$ once each word time. The digital differential analyzers 82 and 84 operate in the same manner except that the Y register 84*a* of DDA 84 is initially at zero and is counted up and down as indicated by the pulses from DDA 80 and 82. As the projectile approaches the target the Y registers 80*a* and 82*a* are counted down and reach zero when the projectile is over the target. The rate at which the R registers 80*c* and 82*c* overflow or underflow is therefore proportional to the remaining time difference changes to the target and hence also proportional to the distance to go. The overflows of DDA 80 and DDA 82 are then summed in DDA 84. The contributions to DDA 84 can be scaled to compensate for the difference between the time difference contributions of TDA and TDB to the actual distance to go equation. The output DTG pulses occur at a rate proportional to the distance to go to the target, or stated otherwise, proportional to the distance from the target along the flight path. Pulses on the plus DTG line indicate that the projectile is in front of the target whereas pulses on the minus DTG line indicate that the projectile is in back of the target. The DTG pulses may be smoothed by an integrater indicated generally at 86 and applied to a means 90 for controlling the vertical control rudders of the projectile. A gating means 88 and delay means 92 are illustrated to indicate that the DTG value does not enter into the control of the vertical control elevators until after the ballistic foldover is complete.

Figure 7:
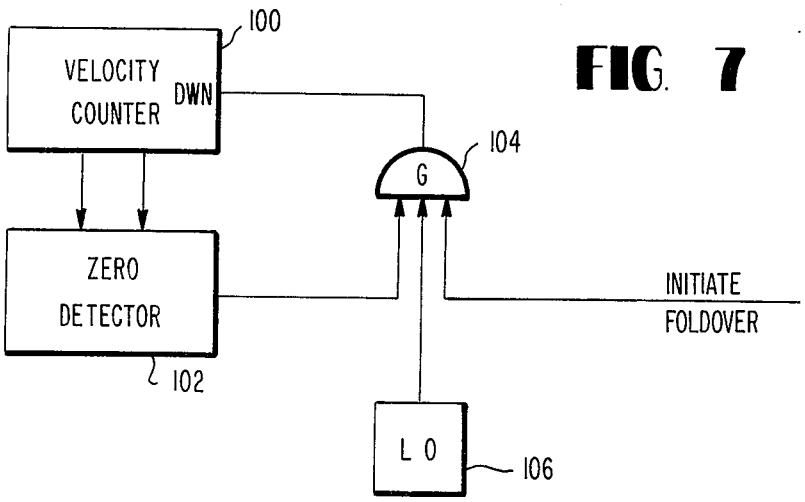
FIG. 7 is a block diagram of apparatus for counting down a velocity counter during ballistic foldover

An additional feature which may be used with the invention is the velocity countdown feature. As is well known, a typical digital Loran-C receiver/processor includes three phase locked loops which track the master, slave A, and slave B pulses respectively. In each loop the locally generated pulses are adjusted in phase to coincide with the received pulses. Each loop may also contain a second order loop called a velocity counter. The velocity counter responds to the phase detection in the loop and its effect is to anticipate the change in time of the received pulses relative to the locally generated pulses and to shift the phase of the locally generated pulses accordingly. The velocity counter will contain a value which corresponds to the velocity of the vehicle carrying the loran receiver/processor. The time constants of a phase locked loop are such that the velocity counter cannot respond instantaneously to a large acceleration or deceleration, such as would be experienced in a ballistic foldover. For example, when executing a ballistic foldover the projectile may vary its horizontal velocity from 600 knots to zero knots in matter of seconds. With the velocity counter having a value therein corresponding to 600 knots, and the loop having a constant which will not react fast enough to the acceleration, the loop will be erroneously tracking the received pulses as the value in the velocity counter decreases from 600 knots to zero knots over a substantially longer period than that corresponding to the actual decrease in velocity of the projectile. One technique for overcoming this problem is to provide a gating means which supplies high frequency pulses to the countdown terminal of the velocity counter in response to the initiated foldover signal. Thus, whenever an initiated foldover signal occurs the velocity counter would be rapidly counted to zero. A simple logic circuit for accomplishing this feature is illustrated in FIG. 7 wherein a velocity counter 100 corresponding to the velocity counter of one loop of the loran receiver/processor within the projectile is shown. It will be apparent that the velocity counters in the other phase locked loops of the loran receiver/-processor may be counted down by substantially identical logic. In response to an initiate foldover signal, pulses from local oscillator 106 are passed through gating means 104 to the countdown terminal of velocity counter 100. The velocity counter rapidly counts down to zero at a preselected rate which condition is detected by the zero detector 102. The output of the zero detector is normally high but when the zero condition is detected the output goes low thereby shutting off gate 104.

Another feature which may be and preferably is used with the present invention is that of an initialization of the projectile's loran receiver/processor from a more sophisticated loran receiver/processor carried on the launch vehicle. Since the projectile is released from an aircraft which may carry a sophisticated loran receiver/processor, the disposable loran receiver/processor on the projectile may be made much simplier and more economical by eliminating certain functions of the processor and, in place thereof, transferring initial conditions from the sophisticated processor on the aircraft to the disposable processor on the projectile. For example, a large savings can be achieved by eliminating the automatic signal acquisition apparatus from the projectile loran receiver/processor and using locally generated synchronous pulses from the phase locked loops of the sophisticated receiver/processor to synchronize the phase locked loops of the less-sophisticated receiver/-processor on the projectile. A specific example of this synchronization will now be described. Assume a conventional and a relatively sophisticated loran receiver/-processor, such as that designated as ARN-92, on the launch vehicle and a receiver/processor somewhat similar thereto on the projectile but lacking automatic acquisition circuitry. An interface may be provided which will extract the master time shared start pulse from the ARN-92 to synchronize the projectile receiver master timer thereby locking it with the ARN-92. The A and B time differences from the ARN-92 will be used to synchronize the A and B time difference registers of the projectile receiver/processors. The three events will lock each of three timers within the projectile receiver to the ARN-92. The fine synchronization will be performed by comparison of the sample triggers of the ARN-92 to the sample triggers of the projectile receiver. The velocity counters and phase shifters can then be slewed for time coincidence of that set of triggers. This will provide for the fine synchronization on the cycle using the ARN-92 as a time base.

What is claimed is:

1. A method of guiding a projectile to a target having loran coordinates TDAT and TDBT via loran processed TDA and TDB signals, comprising the steps of a. launching said projectile from a point having loran coordinates TDAL and TDBL, b. electromechanically controlling the horizontal control rudder of said projectile to cause said projectile to fly a path which is the locus of all points i having a constant ratio $$\frac{TDAT - TDA_i}{TDBT - TDB_i} = \frac{TDAT - TDAL}{TDBT - TDBL},$$

c. initiating a ballistic foldover of said projectile when the projectile reaches a predetermined loran coordinate, said predetermined loran coordinate being selected at a point on said path in advance of the target whereby a ballistic foldover begun at said point will end substantially over said target, and d. electromechanically controlling the vertical control fins of said projectile after said foldover to properly postion said projectile along said path.

2. The method as claimed in claim 1 wherein the step of electromechanically controlling said horizontal rudder comprises, generating signals ($\pm \Delta$ TDA, $\pm \Delta$ TDB) representative of incremental changes in the loran coordinates of said projectile, multiplying said signal representative of incremental changes ($\pm \Delta$ TDB, $\pm \Delta$ TDA) by signals representing the initial launch conditions (TDAT - TDAL) and (TDBT - TDBL), respectively, and generating a signal representing the differential cross track error CTE = ($\Delta$ TDB) (TDAT − TDAL) − ($\Delta$ TDA) (TDBT − TDBL).

3. The method as claimed in claim 1 wherein the step of initiating a ballistic foldover comprises, a. subtracting a signal representing a loran coordinate TDA at launch time from a signal representing a loran coordinate TDAP of the foldover point, b. varying the value TDAP − TDA obtained by said subtracting and calculated at launch time, in accordance with said signals ($\pm \Delta$ TDA) representing incremental changes in the loran coordinate TDA of said projectile, and c. initiating foldover when said varied value TDAP − TDA = 0.

4. The method as claimed in claim 2 wherein the step of initiating a ballistic foldover comprises, a. subtracting a signal representing a loran coordinate TDA at launch time from a signal representing a loran coordinate TDAP of the foldover point, b. varying the value TDAP− TDA obtained by said subtracting and calculated at launch time, in accordance with said signals ($\pm \Delta$ TDA) representing incremental changes in the loran coordinate TDA of said projectile, and c. initiating foldover when said varied value TDAP− TDA = 0.

5. The method as claimed in claim 1 wherein the step of initiating a ballistic foldover comprises, a. subtracting a signal representing a loran coordinate TDB at launch time from a signal representing a loran coordinate TDBP of the foldover point, b. varying the value TDBP− TDB obtained by said subtracting and calculated at launch time, in accordance with said signals ($\pm \Delta$ TDB) representing incremental changes in the loran coordinate TDB of said projectile, and c. initiating foldover when said varied value TDBP−TDB = 0.

6. The method as claimed in claim 2 wherein the step of initiating a ballistic foldover comprises, a. subtracting a signal representing a loran coordinate TDB at launch time from a signal representing a loran coordinate TDBP of the foldover point, b. varying the value TDBP− TDR obtained by said subtracting and calculated at launch time, in accordance with said signals ($\pm \Delta$ TDB) representing incremental changes in the loran coordinate TDB of said projectile, and c. initiating foldover when said varied value TDBP−TDB = 0.

7. The method as claimed in claim 1 wherein the step of electromechanically controlling the vertical fins comprises, a. generating a signal DTG representative of a constant $K_1$ times the difference between the loran coordinate TDAT of said target and the loran coordinate $TDA_i$ of said projectile, where $K_1$ is dependent upon the gradient of TDA and the angle a line between the launch and target points forms with the loran grid lines, and b. altering the angle of the vertical fins to drive said signal DTG to zero.

8. The method as claimed in claim 4 wherein the step of electromechanically controlling the vertical fins comprises, a. generating a signal DTG representative of a constant $K_1$ times the difference between the loran coordinate TDAT of said target and the loran coordinate $TDA_i$ of said projectile, where $K_1$ is dependent upon the gradient of TDA and the angle a line between the launch and target points forms with the loran grid lines, and b. altering the angle of the vertical fins to drive said signal DTG to zero.

9. The method as claimed in claim 6 wherein the step of electromechanically controlling the vertical fins comprises, a. generating a signal DTG representative of a constant $K_1$ times the difference between the loran coordinate TDAT of said target and the loran coordinate $TDA_i$ of said projectile, where $K_1$ is dependent upon the gradient of TDA and the angle a line between the launch and target points forms with the loran grid lines, and b. altering the angle of the vertical fins to drive said signal DTG to zero.

10. The method as claimed in claim 1 wherein the step of electromechanically controlling the vertical fins comprises, a. generating a first signal representative of a first constant $K_{1/2}$ times the difference between the loran coordinate TDAT of said target and the loran coordinate $TDA_i$ of said projectile, b. generating a second signal representative of a second constant $K_{2/2}$ times the difference between the loran coordinate TDBT of said target and the loran coordinate $TDB_i$ of said projectile, c. forming a third signal DTG representative of the sign and magnitude of the sum of said first and second signals, and d. adjusting the angle of the vertical fins to drive said third signal DTG to zero.

11. The method as claimed in claim 4 wherein the step of electromechanically controlling the vertical fins comprises, a. generating a first signal representative of a first constant $K_{1/2}$ times the difference between the loran coordinate TDAT of said target and the loran coordinate $TDA_i$ of said projectile, b. generating a second signal representative of a second constant $K_{2/2}$ times the difference between the loran coordinate TDBT of said target and the loran coordinate $TDB_i$ of said projectile, c. forming a third signal DTG representative of the sign and magnitude of the sum of said first and second signals, and d. adjusting the angle of the vertical fins to drive said third signal DTG to zero.

12. The method as claimed in claim 6 wherein the step of electromechanically controlling the vertical fins comprises, a. generating a first signal representative of a first constant $K_{1/2}$ times the difference between the loran coordinate TDAT of said target and the loran coordinate $TDA_i$ of said projectile, b. generating a second signal representative of a second constant $K_{2/2}$ times the difference between the loran coordinate TDBT of said target and the loran coordinate $TDB_i$ of said projectile, c. forming a third signal DTG representative of the sign and magnitude of the sum of said first and second signals, and d. adjusting the angle of the vertical fins to drive said third signal DTG to zero.

13. The method as claimed in claim 1 wherein the step of electromechanically controlling the vertical fins comprises, a. generating a signal DTG representative of a constant $K_2$ times the difference between the loran coordinate TDBT of said target and the loran coordinate $TDB_i$ of said projectile, where $K_2$ is dependent upon the gradient of TDB and the angle a line between the launch and target points forms with the loran grid lines, and b. altering the angle of the vertical fins to drive said signal DTG to zero.

14. The method as claimed in claim 4 wherein the step of electromechanically controlling the vertical fins comprises, a. generating a signal DTG representative of a constant $K_2$ times the difference between the loran coordinate TDBT of said target and the loran coordinate $TDB_i$ of said projectile, where $K_2$ is dependent upon the gradient of TDB and the angle a line between the launch and target points forms with the loran grid lines, and b. altering the angle of the vertical fins to drive said signal DTG to zero.

15. The method as claimed in claim 6 wherein the step of electromechanically controlling the vertical fins comprises, a. generating a signal DTG representative of a constant $K_2$ times the difference between the loran coordinate TDBT of said target and the loran coordinate $TDB_i$ of said projectile, where $K_2$ is dependent upon the gradient of TDB and the angle a line between the launch and target points forms with the loran grid lines, and b. altering the angle of the vertical fins to drive said signal DTG to zero.

16. A system for guiding a projectile to a target at loran coordinates TDAT and TDBT, said system comprising, a. loran processor means for developing signals representing instantaneous loran coordinates ($TDA_i$ and $TDB_i$) of said projectile, b. means responsive to said signals representing the instantaneous coordinates for generating signals representing difference quantities (TDAT−TDAL) and (TDBT− TDBL), c. means responsive to said signals representing the instantaneous coordinates and to said signals representing difference quantities for generating an error indication whenever said projectile deviates from a flight path which is defined as the locus of all points i for which the ratio TDAT− $TDA_i$/TDBT− $TDB_i$ remains constant, d. means responsive to one of said signals representing said instantaneous coordinates reaching a predetermined value (TDAP or TDBP) for generating a foldover signal for causing a ballistic foldover of said projectile, and e. means responsive to signals representing the loran coordinates of said target and to said signals representing the instantaneous coordinates of said projectile for generating a signal proportional to the distance to go to said target along said path.

17. A system as claimed in claim 16 wherein said projectile is adapted to be launched by a vehicle and further comprising a second loran processor adapted for installation in the launch vehicle and means for transferring synchronization signals from said second loran processor to said other loran processor.

18. A system as claimed in claim 16 wherein said loran processor is of the type having Master, Slave A and Slave B phase locked loops and a velocity counter in each said phase locked loops, said system further comprising, means responsive to said foldover signal for counting down the contents of each said velocity counter.

* * * * *